US007474055B2

(12) United States Patent
Hirota et al.

(10) Patent No.: US 7,474,055 B2
(45) Date of Patent: Jan. 6, 2009

(54) PLASMA DISPLAY PANEL

(75) Inventors: Atsushi Hirota, Yamanashi-ken (JP); Eishiro Otani, Yamanashi-ken (JP); Hai Lin, Yamanashi-ken (JP); Kunimoto Tsuchiya, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 382 days.

(21) Appl. No.: 11/226,413

(22) Filed: Sep. 15, 2005

(65) Prior Publication Data

US 2006/0055325 A1 Mar. 16, 2006

(30) Foreign Application Priority Data

Sep. 16, 2004 (JP) ..... 2004-269673
Jul. 19, 2005 (JP) ..... 2005-208719

(51) Int. Cl.
*H01J 17/49* (2006.01)

(52) U.S. Cl. ..... 313/587; 313/582

(58) Field of Classification Search ..... 313/582, 313/584, 586, 587
See application file for complete search history.

(56) References Cited

U.S. PATENT DOCUMENTS

2006/0066240 A1* 3/2006 Ushizawa et al. ..... 313/586

FOREIGN PATENT DOCUMENTS

| | | | |
|---|---|---|---|
| EP | 1 298 694 | A1 | 4/2003 |
| EP | 1 580 786 | A2 | 9/2005 |
| EP | 1 600 921 | A2 | 11/2005 |
| JP | 6-325696 | | 11/1994 |
| WO | WO 2005/031782 | A1 | 4/2005 |

OTHER PUBLICATIONS

European Search Report dated, Oct. 5, 2007.

* cited by examiner

*Primary Examiner*—Vip Patel
(74) *Attorney, Agent, or Firm*—McGinn IP Law Group, PLLC

(57) ABSTRACT

A plasma display panel has a front glass substrate and a back glass substrate facing each other on either side of a discharge space, row electrode pairs formed on the rear-facing face of the front glass substrate, and a dielectric layer covering the row electrode pairs. Discharge cells are formed in the discharge space. The PDP further has crystalline MgO layers each provided on a part of portion of the face of the front glass substrate having the row electrode pairs formed thereon and facing toward the discharge space. The crystalline MgO layers include magnesium oxide crystals causing a cathode-luminescence emission having a peak within a wavelength range of 200 nm to 300 nm upon excitation by an electron beam.

23 Claims, 16 Drawing Sheets

FIRST EMBODIMENT

FIRST EMBODIMENT

SECTION V1-V1

SECTION W1-W1

SINGLE CRYSTAL OF
CUBIC SINGLE-CRYSTAL STRUCTURE

SINGLE CRYSTALLINE MgO OF
CUBIC POLYCRYSTAL STRUCTURE

SECOND EMBODIMENT

THIRD EMBODIMENT

FOURTH EMBODIMENT

FIFTH EMBODIMENT

SIXTH EMBODIMENT

SEVENTH EMBODIMENT

SECTION V2-V2

SECTION W2-W2

EIGHTH EMBODIMENT

NINTH EMBODIMENT

PLASMA DISPLAY PANEL

BACKGROUND OF THE INVENTION

1. Field of the Invention

This invention relates to a structure of plasma display panels.

The present application claims priority from Japanese Application No. 2005-208719 and No. 2004-269673, the disclosure of which is incorporated herein by reference.

2. Description of the Related Art

A surface-discharge-type alternating-current plasma display panel (hereinafter referred to as "PDP") has two opposing glass substrates placed on either side of a discharge-gas-filled discharge space. One of the two glass substrates has row electrode pairs extending in the row direction and regularly arranged in the column direction. The other glass substrate has column electrodes extending in the column direction and regularly arranged in the row direction. Unit light emission areas (discharge cells) are formed in matrix form in positions corresponding to the intersections between the row electrode pairs and the column electrodes in the discharge space.

The PDP further has a dielectric layer provided for covering the row electrodes or the column electrodes. A magnesium oxide (MgO) film is formed on a portion of the dielectric layer facing each of the unit light emission areas. The MgO film has the function of protecting the dielectric layer and the function of emitting secondary electrons into the unit light emission area.

A conventional method suggested for forming the MgO film of the PDP uses a screen printing technique to apply a coating of a paste containing an MgO powder mixture onto the dielectric layer.

Such a conventional PDP is disclosed in Japanese Patent Laid-open Application No. 6-325696, for example.

However, the conventional MgO film is formed by use of a screen printing technique to apply a coating of a paste mixed with a polycrystalline floccule type magnesium oxide obtained by heat-treating and purifying magnesium hydroxide. Therefore, this MgO film thus formed provides the discharge characteristics of the PDP merely to an extent equal to or slightly greater than that provided by a magnesium oxide film formed by the use of evaporation technique.

An urgent need arising from this is to form a protective film capable of yielding a greater improvement in the discharge characteristics of the PDP.

SUMMARY OF THE INVENTION

An object of the present invention is to solve the problem associated with conventional PDPs having a magnesium oxide film formed as described above.

To attain this object, the present invention provides a plasma display panel having a pair of substrates placed opposite each other on either side of a discharge space, discharge electrodes formed on one of the opposing substrates, and a dielectric layer covering the discharge electrodes, unit light emission areas being formed in the discharge space. The plasma display panel is characterized by crystalline magnesium oxide layers which includes magnesium oxide crystals causing a cathode-luminescence emission having a peak within a wavelength range of 200 nm to 300 nm upon excitation by an electron beam and which are each provided on a portion of the substrate having the discharge electrodes formed thereon and facing the discharge space.

As an exemplary embodiment of the best mode for carrying out the present invention, a PDP has a front glass substrate and a back glass substrate between which are provided row electrode pairs extending in a row direction and column electrodes extending in a column direction to form discharge cells in the discharge space in positions corresponding to intersections with the row electrode pairs. The PDP further has crystalline magnesium oxide layers provided on portions of a dielectric layer which covers either the row electrode pairs or the column electrodes, each portion facing a discharge cell and including an area facing at least either the row electrode or the column electrode. The crystalline magnesium oxide layers include magnesium oxide crystals causing a cathode-luminescence emission having a peak within a wavelength range of 200 nm to 300 nm upon excitation by an electron beam.

Each of he crystalline magnesium oxide layers including magnesium oxide crystals causing a cathode-luminescence emission having a peak within a wavelength range of 200 nm to 300 nm upon excitation by an electron beam is formed on at least a part, that is, that facing either the row electrode or the column electrode, within the portion of the dielectric layer facing the discharge cell. Because of this, the discharge characteristics of the PDP such as those relating to the discharge delay are improved. Thus, the PDP in the exemplary embodiment is capable of having satisfactory discharge characteristics.

Further, the formation of each of the crystalline magnesium oxide layers in a selected area including an area facing the row electrode or the column electrode makes it possible to greatly enhance the effect of shortening the discharge-delay time and to minimize the light-transmission reduction caused by the formation of the crystalline magnesium oxide layers.

In the PDP, the crystalline magnesium oxide layers can be provided by being partially laminated on the thin film magnesium-oxide layer covering the dielectric layer, or alternatively they may be formed directly on required portions of the dielectric layer without a thin film magnesium-oxide layer.

If the crystalline magnesium oxide layers are formed directly on the portions of the dielectric layer, the crystalline magnesium oxide layers limit the discharge area to enable the initiation of a discharge only in the region of a high electric field strength, thereby making it possible to provide a high luminous efficiency.

These and other objects and features of the present invention will become more apparent from the following detailed description with reference to the accompanying drawings.

DETAILED DESCRIPTION OF THE PREFERRED EMBODIMENTS

First Embodiment

Figure 1:
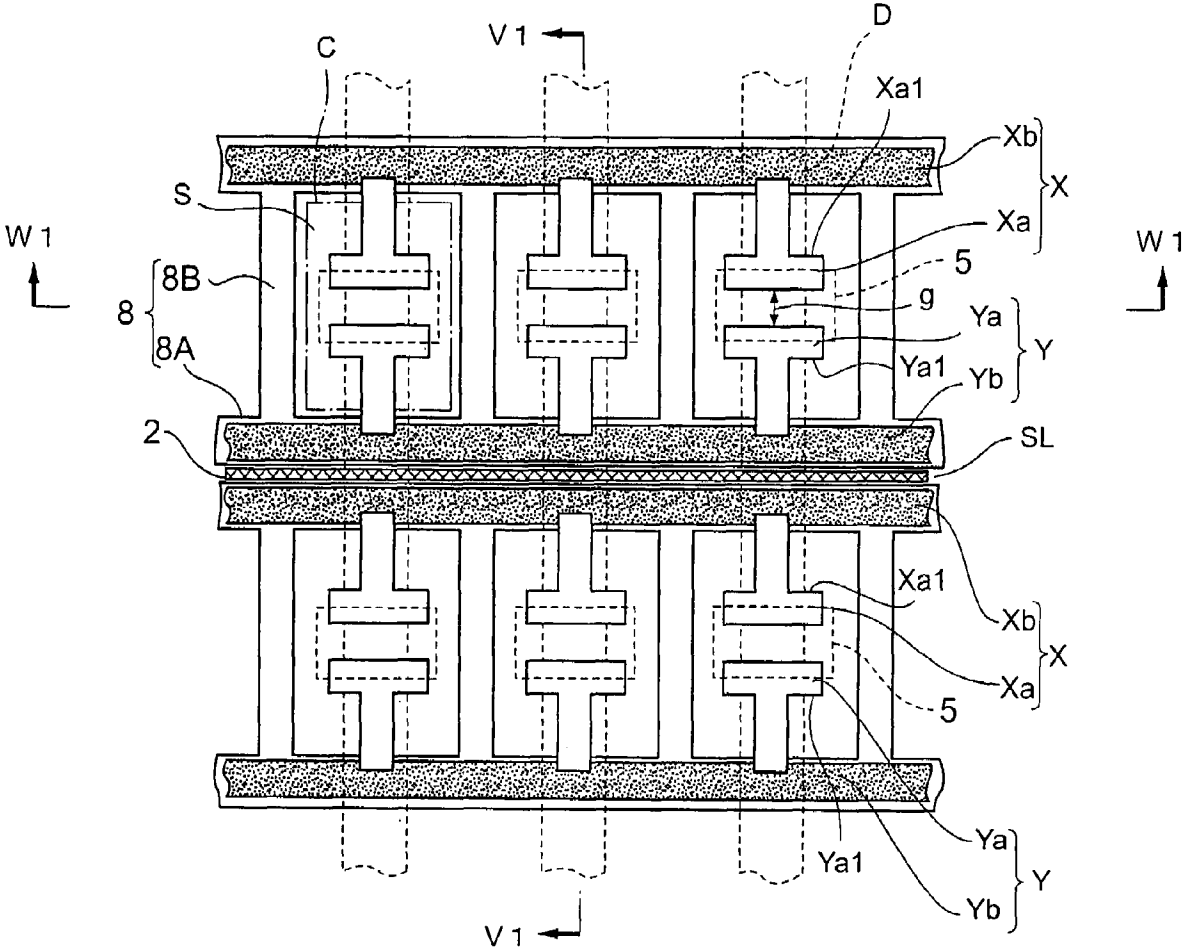
FIG. 1 is a front view illustrating a first embodiment of the present invention.
Figure 2:
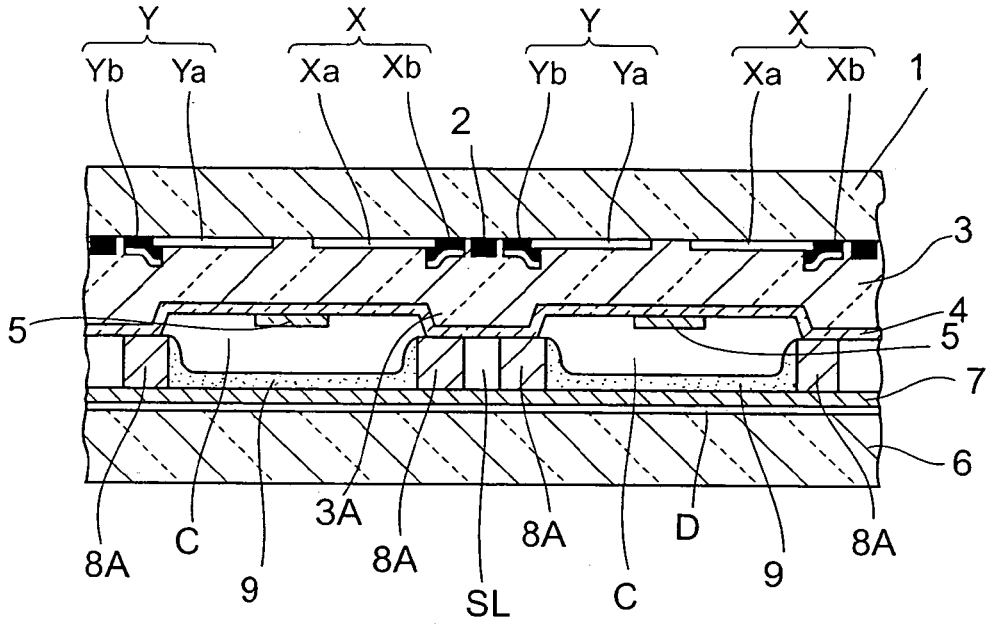
FIG. 2 is a sectional view taken along the V1-V1 line in FIG. 1.
Figure 3:
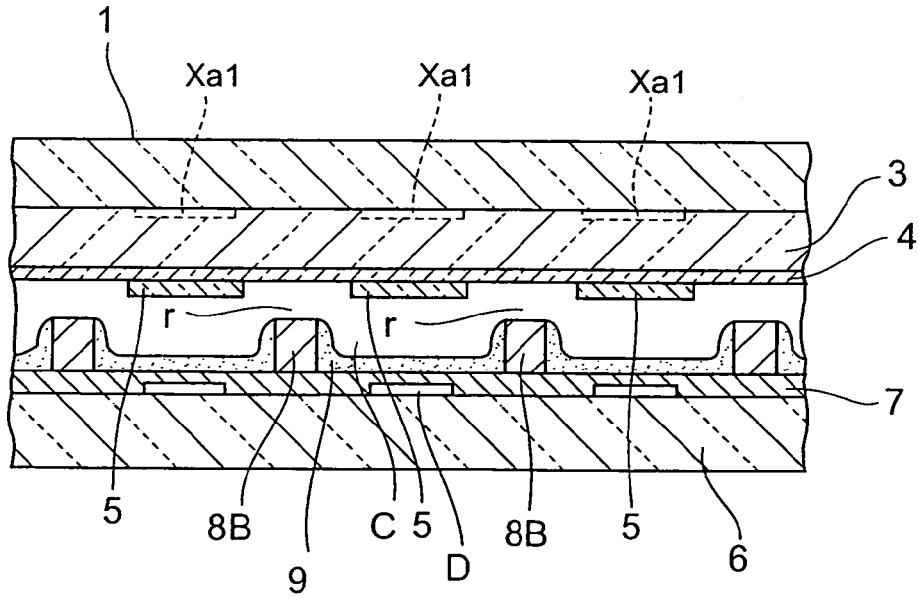
FIG. 3 is a sectional view taken along the W1-W1 line in FIG. 1.

FIGS. 1 to 3 illustrate a first embodiment of a PDP according to the present invention. FIG. 1 is a schematic front view of the PDP in the first embodiment. FIG. 2 is a sectional view taken along the V1-V1 line in FIG. 1. FIG. 3 is a sectional view taken along the W1-W1 line in FIG. 1.

The PDP in FIGS. 1 to 3 has a plurality of row electrode pairs (X, Y) extending and arranged in parallel on the rear-facing face (the face facing toward the rear of the PDP) of a front glass substrate 1 serving as a display surface in a row direction of the front glass substrate 1 (the right-left direction in FIG. 1).

A row electrode X is composed of T-shaped transparent electrodes Xa formed of a transparent conductive film made of ITO or the like, and a bus electrode Xb formed of a metal film. The bus electrode Xb extends in the row direction of the front glass substrate 1. The narrow proximal end (corresponding to the foot of the "T") of each transparent electrode Xa is connected to the bus electrode Xb.

Likewise, a row electrode Y is composed of T-shaped transparent electrodes Ya formed of a transparent conductive film made of ITO or the like, and a bus electrode Yb formed of a metal film. The bus electrode Yb extends in the row direction of the front glass substrate 1. The narrow proximal end of each transparent electrode Ya is connected to the bus electrode Yb.

The row electrodes X and Y are arranged in alternate positions in a column direction of the front glass substrate 1 (the vertical direction in FIG. 1). In each row electrode pair (X, Y), the transparent electrodes Xa and Ya are regularly spaced along the associated bus electrodes Xb and Yb and each extends out toward its counterpart in the row electrode pair, so that the wide distal ends (corresponding to the head of the "T") of the transparent electrodes Xa and Ya face each other with a discharge gap g having a required width in between.

Black- or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the row electrode pairs (X, Y) adjacent to each other in the column direction.

A dielectric layer 3 is formed on the rear-facing face of the front glass substrate 1 so as to cover the row electrode pairs (X, Y), and has additional dielectric layers 3A projecting from the rear-facing face thereof. Each of the additional dielectric layers 3A extends in parallel to the back-to-back bus electrodes Xb, Yb of the adjacent row electrode pairs (X, Y) in a position opposite to the bus electrodes Xb, Yb and the area between the bus electrodes Xb, Yb.

On the rear-facing faces of the dielectric layer 3 and the additional dielectric layers 3A, a magnesium oxide layer 4 of thin film (hereinafter referred to as "thin-film MgO layer 4") formed by vapor deposition or spattering and covers the entire rear-facing faces of the layers 3 and 3A.

Magnesium oxide layers 5 including magnesium oxide single crystals (hereinafter referred to as "crystalline MgO layers 5") are laminated on the rear-facing face of the thin-film MgO layer 4. Each of the crystalline MgO layers 5 is formed in an island form on a quadrangular portion of the thin-film MgO layer 4 which faces the opposing parts of the transparent electrodes Xa and Ya (the parts of the wide distal ends Xa1 and Ya1 bordering the discharge gap g between the transparent electrodes Xa and Ya) and this discharge gap g between the transparent electrodes Xa and Ya. The magnesium oxide single crystals included in the crystalline MgO layer 5 cause a cathode-luminescence emission (CL emission) having a peak within a wavelength range of 200 nm to 300 nm (particularly, of 230 nm to 250 nm, around 235 nm) upon excitation by electron beams as described later.

The front glass substrate 1 is parallel to a back glass substrate 6. Column electrodes D are arranged in parallel at predetermined intervals on the front-facing face (the face facing toward the display surface) of the back glass substrate 6. Each of the column electrodes D extends in a direction at right angles to the row electrode pair (X, Y) (i.e. the column direction) along a strip opposite to the paired transparent electrodes Xa and Ya of each row electrode pair (X, Y).

On the front-facing face of the back glass substrate 6, a white column-electrode protective layer (dielectric layer) 7 covers the column electrodes D and in turn partition wall units 8 are formed on the column-electrode protective layer 7.

Each of the partition wall units 8 is formed in an approximate ladder shape made up of a pair of transverse walls 8A extending in the row direction in the respective positions opposite to the bus electrodes Xb and Yb of each row electrode pair (X, Y), and vertical walls 8B each extending in the column direction between the pair of transverse walls 8 in a mid-position between the adjacent column electrodes D. The partition wall units 8 are regularly arranged in the column direction in such a manner as to form an interstice SL extending in the row direction between the back-to-back transverse walls 8A of the adjacent partition wall sets 8.

The ladder-shaped partition wall units 8 partition the discharge space S defined between the front glass substrate 1 and the back glass substrate 6 into quadrangles to form discharge cells C in positions each corresponding to the paired transparent electrodes Xa and Ya of each row electrode pair (X, Y).

The front-facing face of each of the transparent walls 8A of the partition wall units 8 is in contact with the thin-film MgO layer 4 covering the additional dielectric layer 3A (see FIG. 2), to block off the discharge cell C and the interstice SL from each other. However, the front-facing face of the vertical wall 8B is out of contact with the thin-film MgO layer 4 (see FIG. 3), to form a clearance r therebetween, so that the adjacent discharge cells C in the row direction interconnect with each other by means of the clearance r.

In each discharge cell C, a phosphor layer 9 covers five faces: the side faces of the transverse walls 8A and the vertical walls 8B of the partition wall unit 8 and the face of the column-electrode protective layer 7. The three primary colors, red, green and blue, are individually applied to the phosphor layers 9 such that the red, green and blue discharge cells C are arranged in order in the row direction.

The discharge space S is filled with a discharge gas including xenon.

For the buildup of the crystalline MgO layer 5, a spraying technique, electrostatic coating technique or the like is used to cause the MgO crystals as described earlier to adhere to the rear-facing face the thin-film MgO layer 4 covering the dielectric layer 3 and the additional dielectric layers 3A.

Figure 4:
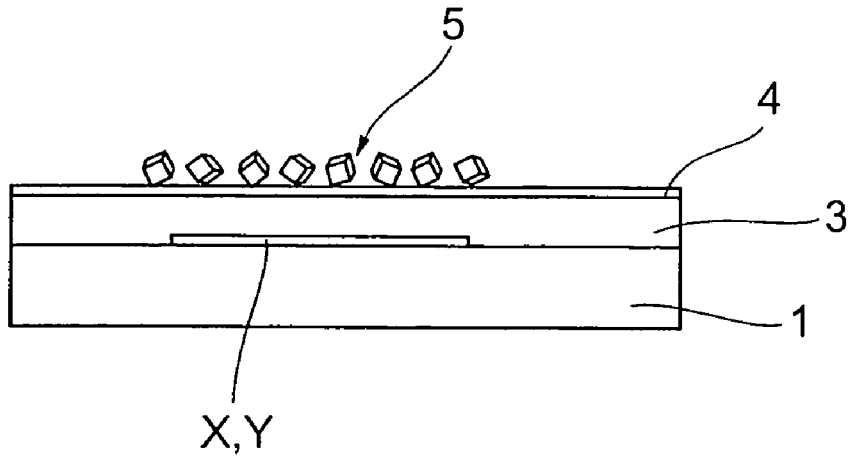
FIG. 4 is a sectional view showing the state of a crystalline magnesium oxide layer formed on a thin film magnesium layer in the first embodiment.

FIG. 4 shows the state when the thin-film MgO layer 4 is first formed on the rear-facing face of the dielectric layer 3 and then MgO crystals are affixed to the rear-facing face of the thin-film MgO layer 4 to form the crystalline MgO layer 5 by use of a spraying technique, electrostatic coating technique or the like.

Figure 5:
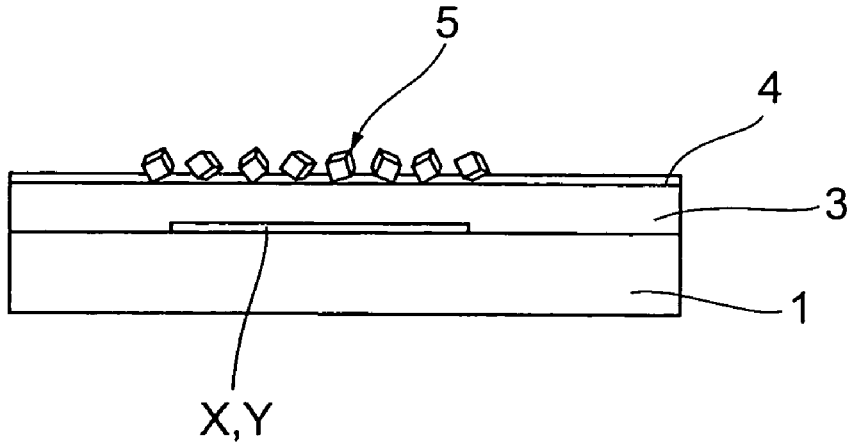
FIG. 5 is a sectional view showing the state of a thin film magnesium layer formed on a crystalline magnesium oxide layer in the first embodiment.

FIG. 5 shows the state when the MgO crystals are affixed to the rear-facing face of the dielectric layer 3 to form the crystalline MgO layer 5 by use of a spraying technique, electrostatic coating technique or the like, and then the thin-film Mgo layer 4 is formed.

The crystalline MgO layer 5 of the PDP is formed by use of the following materials and method.

Figure 6:
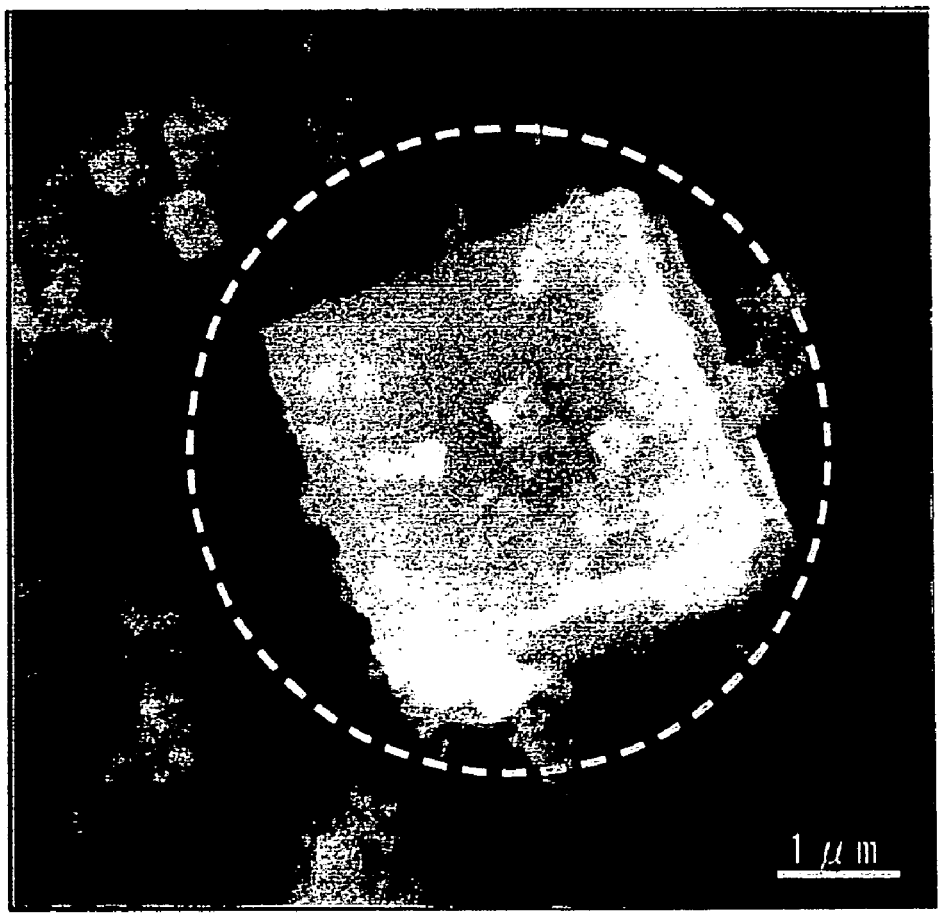
FIG. 6 is a SEM photograph of the magnesium oxide single crystal having a cubic single-crystal structure.
Figure 7:
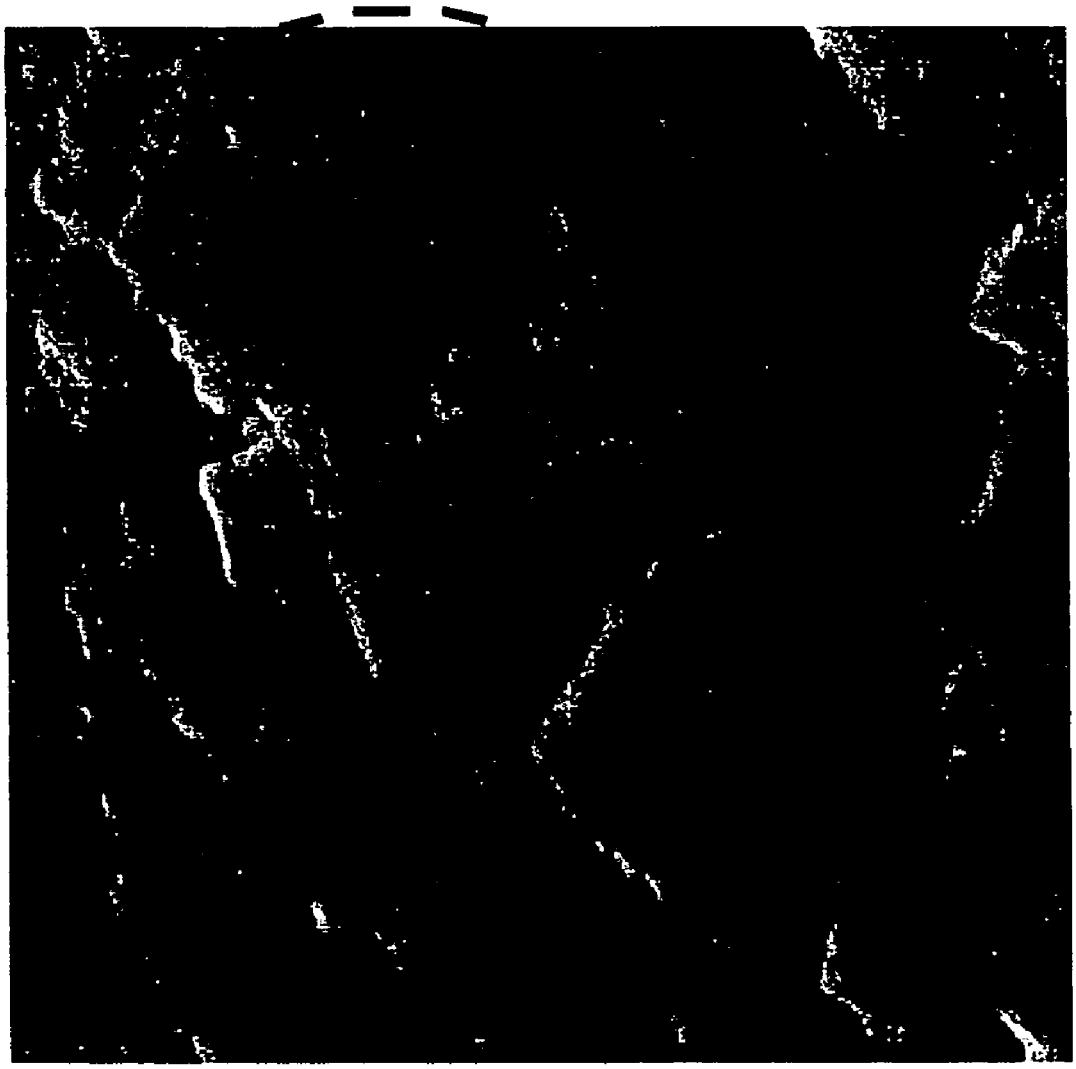
FIG. 7 is a SEM photograph of the magnesium oxide single crystal having a cubic polycrystal structure.

MgO crystals, used as materials for forming the crystalline MgO layer 5 and causing CL emission having a peak within a wavelength range of 200 nm to 300 nm (particularly, of 230 nm to 250 nm, around 235 nm) by being excited by an electron beam, include crystals such as a single crystal of magnesium which is obtained, for example, by performing vapor-phase oxidization on magnesium steam generated by heating magnesium (this single crystal of magnesium is hereinafter referred to as "vapor-phase MgO single crystal") As the vapor-phase MgO single crystals are included an MgO single crystal having a cubic single crystal structure as illustrated in the SEM photograph in FIG. 6, and an MgO single crystal having a structure of cubic crystals fitted to each other (i.e. a cubic polycrystal structure) as illustrated in the SEM photograph in FIG. 7, for example.

The vapor-phase MgO single crystal contributes to an improvement of the discharge characteristics such as a reduction in discharge delay as described later.

As compared with that obtained by other methods, the vapor-phase magnesium oxide single crystal has the features of being of a high purity, taking a microscopic particle form, causing less particle agglomeration, and the like.

The vapor-phase MgO single crystal used in the first embodiment has an average particle diameter of 500 or more angstroms (preferably, 2000 or more angstroms) based on a measurement using the BET method.

Note that the preparation of the vapor-phase MgO single crystal is described in "Preparation of magnesia powder using a vapor phase method and its properties" ("Zairyou (Materials)" vol. 36, no. 410, pp. 1157-1161, the November 1987 issue), and the like.

The crystalline MgO layer 5 is formed, for example, by the affixation of the vapor-phase MgO single crystal by use of a spraying technique, electrostatic coating technique or the like as described earlier.

In the above-mentioned PDP, a reset discharge, an address discharge and a sustaining discharge for generating an image are produced in the discharge cell C.

The reset discharge initiated prior to the initiation of the address discharge triggers the radiation of vacuum ultraviolet light from the xenon included in the discharge gas. The vacuum ultraviolet light triggers the emission of secondary electrons (priming particles) from the crystalline MgO layer 5 formed so as to face the discharge cell C, resulting in a reduction in the breakdown voltage at the time of the subsequent address discharge and in turn a speeding up of the address discharge process.

Figure 8:
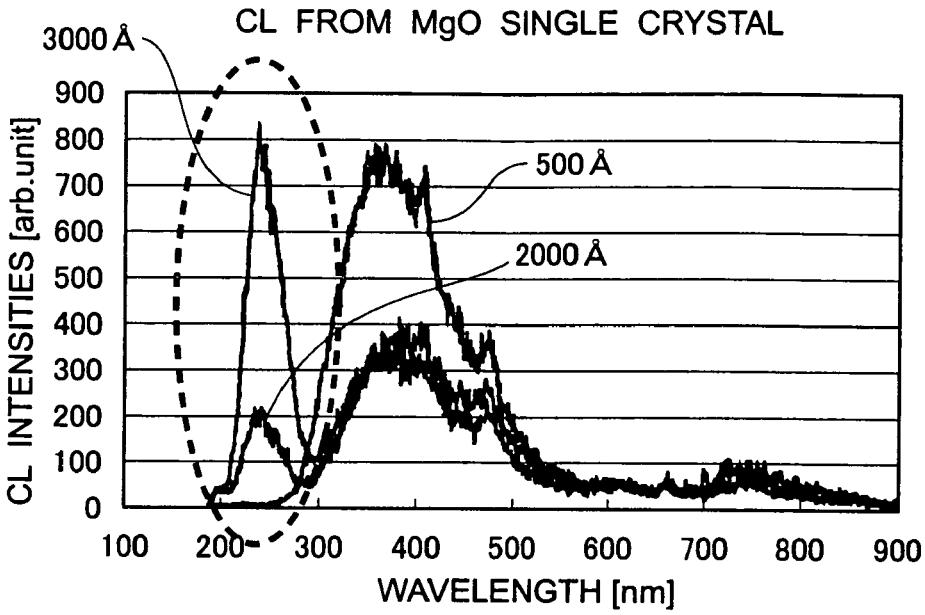
FIG. 8 is a graph showing the relationship between the particle sizes of magnesium oxide single-crystal powder and the wavelengths of CL emission in the first embodiment.
Figure 9:
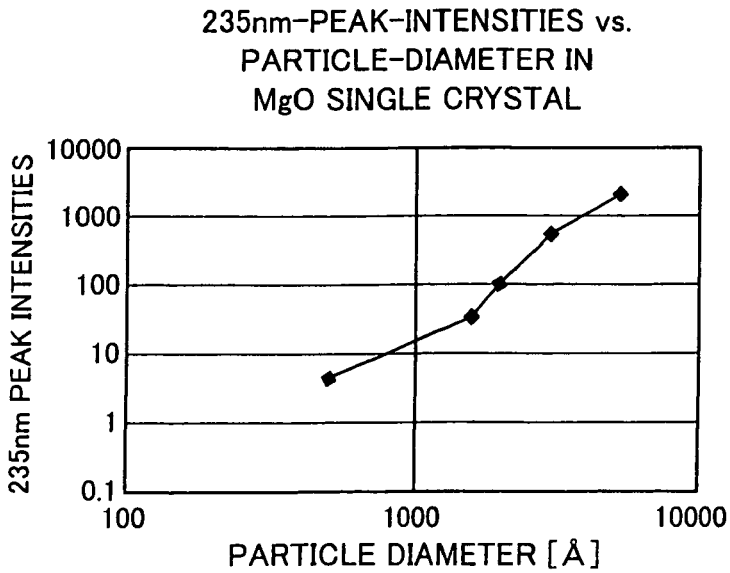
FIG. 9 is a graph showing the relationship between the particle sizes of magnesium oxide single-crystal powder and the intensities of CL emission at 235 nm in the first embodiment.

Because the crystalline MgO layer 5 is formed, for example, of the vapor-phase MgO single crystal, in the PDP the application of electron beam initiated by the discharge excites a CL emission having a peak within a wavelength range of 200 nm to 300 nm (particularly, of 230 nm to 250 nm, around 235 nm), in addition to a CL emission having a peak within a wavelength range of 300 nm to 400 nm, from the large-particle-diameter vapor-phase MgO single crystal included in the crystalline MgO layer 5, as shown in FIGS. 8 and 9.

Figure 10:
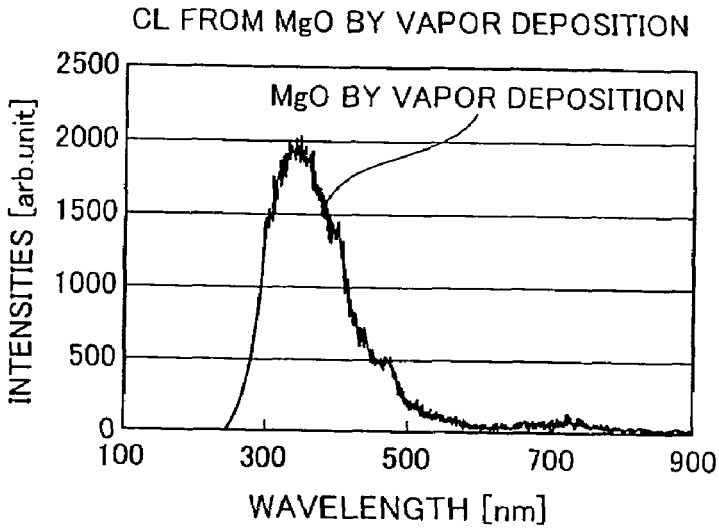
FIG. 10 is a graph showing the state of the wavelength of CL emission from the magnesium oxide layer formed by vapor deposition.

As shown in FIG. 10, a CL emission with peak wavelengths around 235 nm is not excited from a MgO layer formed typically by use of vapor deposition (the thin film MgO layer 4 in the first embodiment), but only a CL emission having a peak wavelengths from 300 nm to 400 nm is excited.

As seen from FIGS. 8 and 9, the greater the particle diameter of the vapor-phase MgO single crystal, the stronger the peak intensity of the CL emission having a peak within the wavelength range from 200 nm to 300 nm (particularly, of 230 nm to 250 nm, around 235 nm).

It is conjectured that the presence of the CL emission having the peak wavelength from 200 nm to 300 nm will bring about a further improvement of the discharge characteristics (a reduction in discharge delay, an increase in the probability of a discharge).

More specifically, the conjectured reason that the crystalline MgO layer 5 causes the improvement of the discharge characteristics is because the vapor-phase MgO single crystal causing the CL emission having a peak within the wavelength range from 200 nm to 300 nm (particularly, of 230 nm to 250 nm, around 235 nm) has an energy level corresponding to the peak wavelength, so that the energy level enables the trapping of electrons for long time (some msec. or more), and the trapped electrons are extracted by an electric field so as to serve as the primary electrons required for starting a discharge.

Also, because of the correlationship between the intensity of the CL emission and the particle size of the vapor-phase MgO single crystal, the stronger the intensity of the CL emission having a peak within the wavelength range from 200 nm to 300 nm (particularly, of 230 nm to 250 nm, around 235 nm), the greater the improvement of the discharge characteristics caused by the vapor-phase MgO single crystal.

In other words, when a vapor-phase MgO single crystal to be deposited has a large particle size, an increase in the heating temperature for generating magnesium vapor is required. Because of this, the length of flame with which magnesium and oxygen react increases, and therefore the temperature difference between the flame and the surrounding ambience increases. Thus, it is conceivable that the larger the particle size of the vapor-phase MgO single crystal, the greater the number of energy levels occurring in correspondence with the peak wavelengths (e.g. around 235 nm, a range from 230 nm to 250 nm) of the CL emission as described earlier.

In a further conjecture regarding the vapor-phase MgO single crystal of a cubic polycrystal structure, many plane defects occur, and the presence of energy levels arising from these plane defects contributes to an improvement in discharge probability.

The BET specific surface area (s) is measured by a nitrogen adsorption method. The particle diameter ($D_{BET}$) of the vapor-phase MgO single crystal powder forming the crystalline MgO layer 5 is calculated from the measured value by the following equation.

$$D_{BET}=A/(s\times\rho),$$

where

A: shape count (A=6)

ρ: real density of magnesium.

Figure 11:
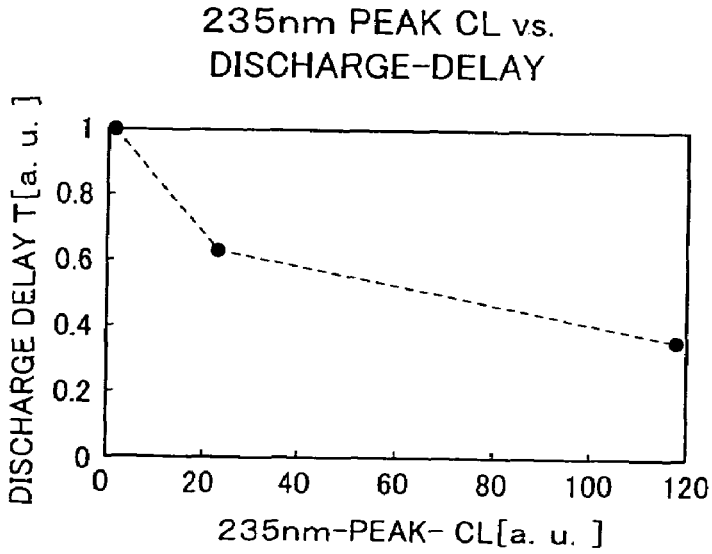
FIG. 11 is a graph showing the relationship between the discharge delay and the peak intensities of CL emission at 235 nm from the magnesium oxide single crystal.

FIG. 11 is a graph showing the correlatioship between the CL emission intensities and the discharge delay.

It is seen from FIG. 11 that the display delay in the PDP is shortened by the 235-nm CL emission excited from the crystalline MgO layer 5, and further as the intensity of the 235-nm CL emission increases, the discharge delay time is shortened.

Figure 12:
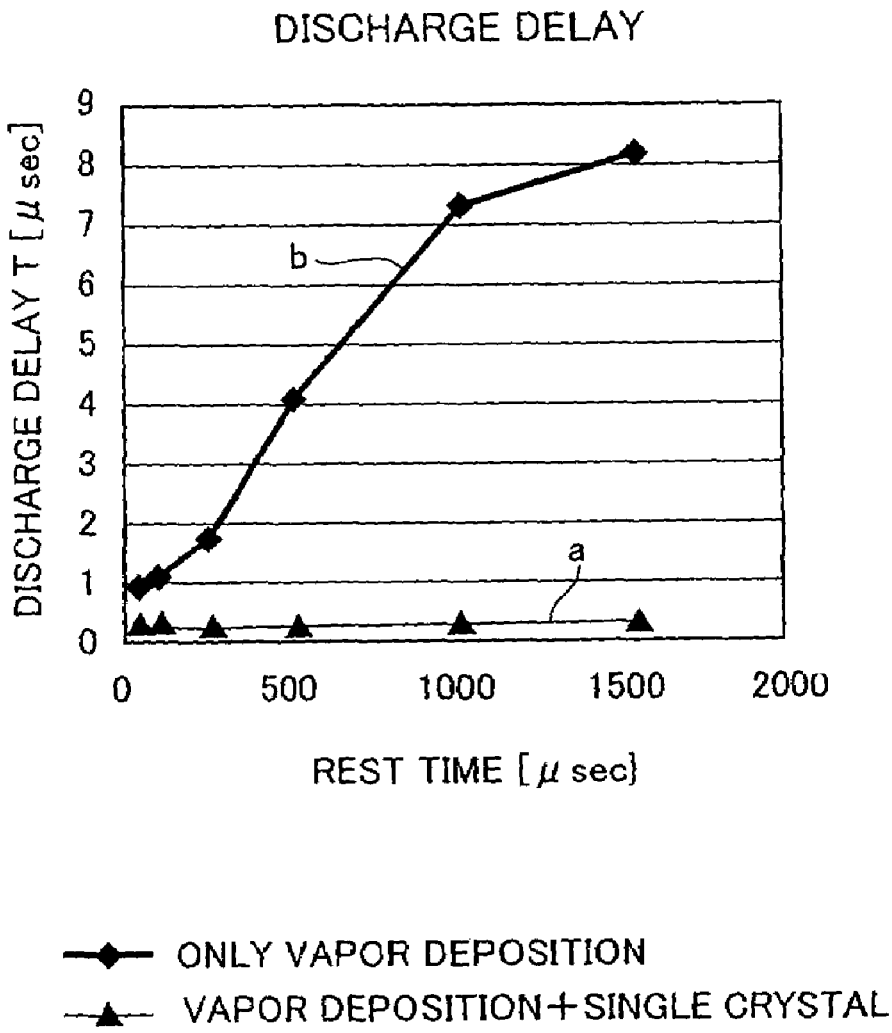
FIG. 12 is a graph showing the comparison of the discharge delay characteristics between the case when the protective layer is constituted only of the magnesium oxide layer formed by vapor deposition and that when the protective layer has a double layer structure made up of a crystalline magnesium oxide layer including magnesium oxide single crystal and a thin film magnesium layer formed by vapor deposition.

FIG. 12 shows the comparison of the discharge delay characteristics between the case of the PDP having the double-layer structure of the thin-film MgO layer 4 and the crystalline MgO layer 5 as described earlier (Graph a), and the case of a conventional PDP having only a MgO layer formed by vapor deposition (Graph b).

As seen from FIG. 12, the double-layer structure of the thin-film MgO layer 4 and the crystalline MgO layer 5 of the PDP according to the present invention offers a significant improvement in the discharge delay characteristics of the PDP over that of a conventional PDP having only a thin-film MgO layer formed by vapor deposition.

As described hitherto, the PDP of the present invention has, in addition to the conventional type of the thin-film MgO layer 4 formed by vapor deposition or the like, the crystalline MgO layers 5 formed of the MgO crystals causing a CL emission having a peak within a wavelength range from 200 nm to 300 nm upon excitation by an electron beam, and each of the crystalline MgO layers 5 is laminated on a portion of the thin-film MgO layer 4 facing the opposing portions of the transparent electrodes Xa and Ya (the parts of the wide distal ends Xa1 and Ya1 bordering the discharge gap g between the transparent electrodes Xa and Ya) and also a quadrangular portion of the thin-film MgO layer 4 facing the discharge gap g between the transparent electrodes Xa and Ya. This design allows an improvement of the discharge characteristics such as those relating to the discharge delay. Thus, the PDP of the present invention is capable of showing satisfactory discharge characteristics.

Specially, the crystalline MgO layer 5 is not formed on the entire face of the thin-film MgO layer, but only in a region where a discharge intensely occurs, thus having an enhanced effect of reducing the discharge delay time.

The vapor-phase MgO single crystal used for forming the crystalline MgO layer 5 has an average particle diameter of 500 or more angstroms based on a measurement using the BET method, preferably, of a range from 2000 Å to 4000 Å.

The PDP of the present invention has the crystalline MgO layers 5 formed, in a pattern of an island form, on a portion of the thin-film MgO layer 4 facing the opposing portions of the transparent electrodes Xa and Ya (the parts of the wide distal ends Xa1 and Ya1 bordering the discharge gap g between the transparent electrodes Xa and Ya) and also a quadrangular portion of the thin-film MgO layer 4 facing the discharge gap g between the transparent electrodes Xa and Ya. As a result, the PDP of the present invention is capable of minimize the light-transmission reduction caused by the lamination of the thin-film MgO layer 4 and the crystalline MgO layer 5.

Further, the formation of the crystalline MgO layers 5 in a pattern of an island form makes it possible to minimize the occurrence of a reduction in the discharge characteristics and a reduction in light transmission in an agglomeration area of the crystalline MgO resulting from the re-buildup of the crystalline MgO having flied off because of the ion impact (spattering) caused by discharges repeated in the discharge cell C.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Further, the foregoing has described the example when the crystalline MgO layer 5 is formed through affixation by use of a spraying technique, an electrostatic coating technique or the like. However, the crystalline MgO layer 5 may be formed through application of a coating of a paste including a vapor-phase MgO single crystal by use of a screen printing technique, an offset printing technique, a dispenser technique, an inkjet technique, a roll-coating technique or the like.

Still further, the foregoing has described the example when the crystalline MgO layer 5 faces the parts of the wide distal ends Xa1, Ya1 bordering the discharge gap g between the transparent electrodes Xa, Ya. However, the crystalline MgO layer may be formed in such a manner as to face the approximate entire areas of the wide distal ends Xa1, Ya1 of the transparent electrodes Xa, Ya.

Second Embodiment

Figure 13:
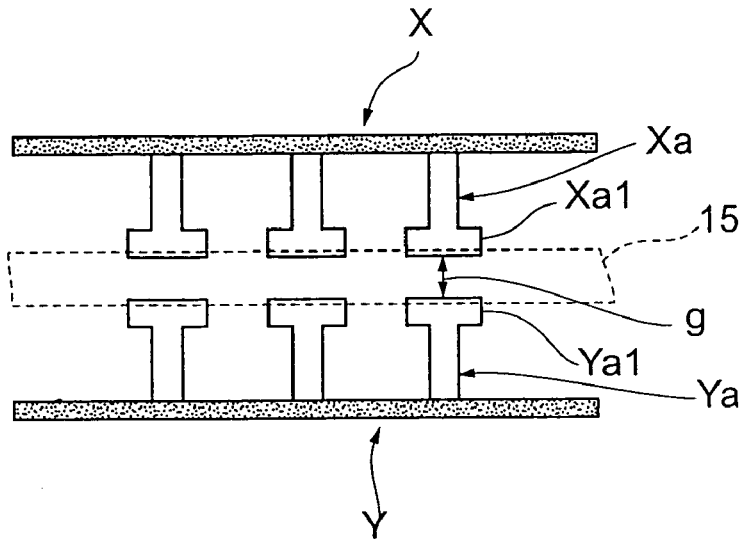
FIG. 13 is a front view illustrating a second embodiment according to the present invention.

FIG. 13 is a schematic block diagram illustrating a second embodiment according to the present invention.

The first embodiment has described the crystalline MgO layers formed in a pattern of an island form and each laminated on a quadrangular portion of the thin-film MgO layer facing the discharge gap and the wide distal ends of the paired and opposing transparent electrodes on either side of the discharge gap.

On the other hand, crystalline MgO layers 15 of the PDP in the second embodiment are formed, in a pattern of a stripe shape, on the rear-facing face of a thin-film MgO layer which is formed as in the case of that in the first embodiment. Each of the crystalline MgO layers 15 is formed on a strip portion of the thin-film MgO layer extending in the row direction and including portion facing the discharge gaps g and the leading tops of the wide distal ends Xa1 and Ya1 of the paired and opposing transparent electrodes Xa and Ya on either side of the discharge gaps g.

The structure of the other components in FIG. 13 is the same as that in the first embodiment and designated by the same reference numerals as those in the first embodiment.

Further, the structure of the crystalline MgO layer 15 and the method of forming it are the same as those in the first embodiment.

The PDP in the second embodiment has, in addition to the conventional type of the thin-film MgO layer formed by vapor deposition or the like, the crystalline MgO layers 15 formed of the MgO crystals causing a CL emission having a peak within a wavelength range from 200 nm to 300 nm (particularly, of 230 nm to 250 nm, around 235 nm) upon excitation by an electron beam, and each of the crystalline MgO layers 15 is formed in a pattern of a shape of a strip including the area facing the discharge gaps g and the opposing portions of the wide distal ends Xa1 and Ya1 of the transparent electrodes Xa and Ya. This design allows an improvement of the discharge characteristics such as those relating to the discharge delay. Thus, the PDP of the present invention is capable of showing satisfactory discharge characteristics.

Specially, the crystalline MgO layer 15 is not formed on the entire face of the thin-film MgO layer, but only in a region where a discharge intensely occurs, thus having an enhanced effect of reducing the discharge delay time.

The PDP in the second embodiment has the crystalline MgO layers 15 formed only in a region where a discharge intensely occurs. As a result, the PDP of the present invention is capable of minimize the light-transmission reduction caused by the lamination of the thin-film MgO layer and the crystalline MgO layer 15.

Further, the formation of the crystalline MgO layers 15 in a pattern as described above makes it possible to minimize the occurrence of a reduction in the discharge characteristics and a reduction in light transmission in an agglomeration area of the crystalline MgO resulting from the re-buildup of the crystalline MgO having flied off because of the ion impact (spattering) caused by discharges repeated in the discharge cells C.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Third Embodiment

Figure 14:
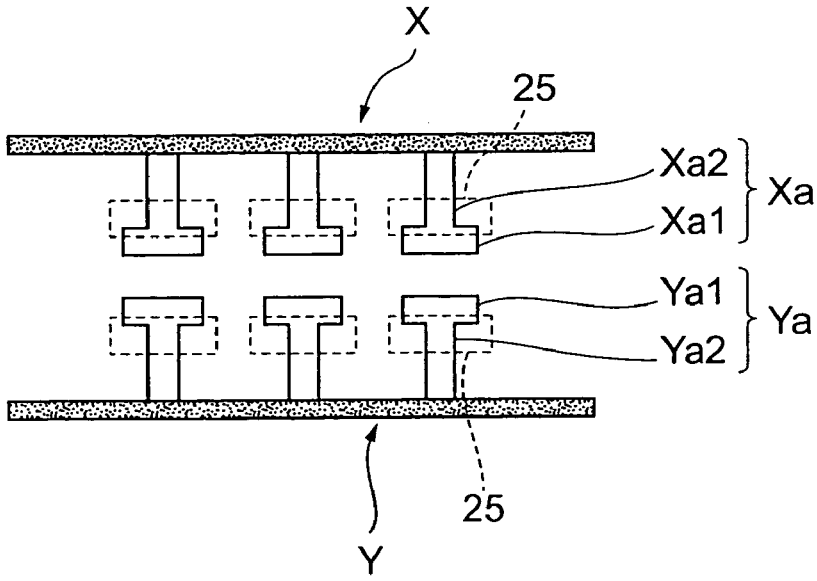
FIG. 14 is a front view illustrating a third embodiment according to the present invention.

FIG. 14 is a schematic block diagram illustrating a third embodiment according to the present invention.

The first embodiment has described the crystalline MgO layers each formed on a quadrangular portion of the thin-film MgO layer facing the discharge gap and the leading ends of the paired and opposing transparent electrodes on either side of the discharge gap.

On the other hand, the PDP in the third embodiment has crystalline MgO layers 25 formed in a pattern of an island form on the rear-facing face of a thin-film MgO layer which is formed as in the case of that in the first embodiment. Each of the crystalline MgO layers 25 is provided on a portion of the thin-film MgO layer facing a quadrangular area including a joint portion of each of the T-shaped transparent electrodes Xa, Ya between the wide distal end Xa1 (Ya1) and the narrow proximal end Xa2 (Ya2) connecting the wide distal end Xa1 (Ya1) to the bus electrode Xb (Yb).

Each of the crystalline MgO layers 25 does not face the discharge gap and the leading ends of the opposing transparent electrodes on either side of the discharge gap which face the crystalline MgO layer in the first embodiment.

The structure of the other components in FIG. 14 is the same as that in the first embodiment and designated by the same reference numerals as those in the first embodiment.

Further, the structure of the crystalline MgO layer 25 and the method of forming it are the same as those in the first embodiment.

The PDP in the third embodiment has, in addition to the conventional type of the thin-film MgO layer formed by vapor deposition or the like, the crystalline MgO layers 25 formed of the MgO crystals causing a CL emission having a peak within a wavelength range from 200 nm to 300 nm (particularly, of 230 nm to 250 nm, around 235 nm) upon excitation by an electron beam. The crystalline MgO layers 25 are formed in a pattern of an island form and each located in the area corresponding to the quadrangular area including the joint portion between the wide distal end Xa1 (Ya1) and the narrow proximal end Xa2 (Ya2) of each of the transparent electrodes Xa, Ya. This design allows an improvement of the discharge characteristics such as those relating to the discharge delay. Thus, the PDP of the present invention is capable of showing satisfactory discharge characteristics.

Each of the crystalline MgO layers 25 is formed in a region next to a region where a discharge intensely occurs, there by making it possible to greatly enhance the effect of shortening the discharge-delay time. Further, the crystalline Mgo layers 25 are formed with a voiding the areas where a discharge most intensely occurs, thereby making it possible to control the light transmission reduction resulting from the re-buildup and the flying-off of the crystalline MgO because of the ion impact (spattering) when discharges are produced.

Because the crystalline MgO layer 25 is not formed on the entire face of the thin-film MgO layer, but only in a region where a discharge intensely occurs, the PDP is capable of minimizing a light transmission reduction caused by the lamination of the thin-film MgO layer and the crystalline MgO layer 25.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Fourth Embodiment

Figure 15:
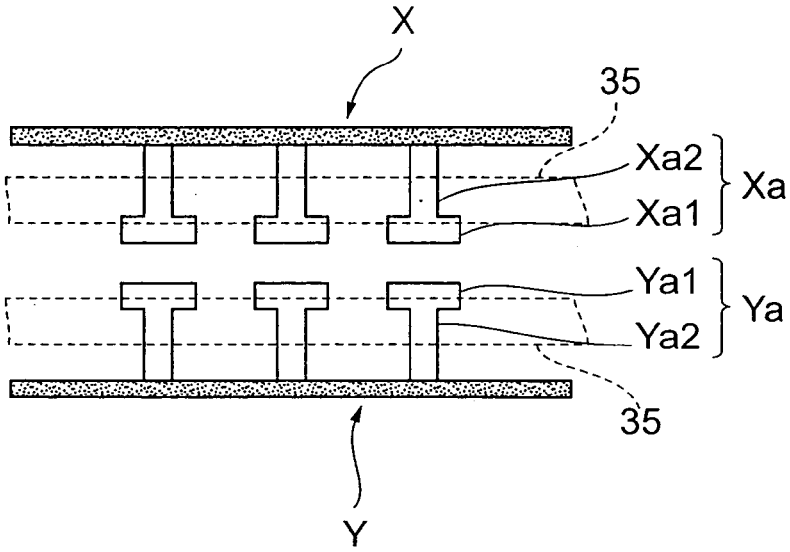
FIG. 15 is a front view illustrating a fourth embodiment according to the present invention.

FIG. 15 is a schematic block diagram illustrating a fourth embodiment according to the present invention.

The crystalline MgO layers in the third embodiment are formed in a pattern of an island form and each located in a position corresponding to a quadrangular area including a joint portion of each of the T-shaped transparent electrodes lying between the wide distal end and the narrow proximal end of each.

On the other hand, crystalline MgO layers 35 of the PDP in the fourth embodiment are formed in a pattern of a stripe shape on the rear-facing face of a thin-film MgO layer formed as in the case of that in the first embodiment. Each of the crystalline MgO layers 35 is formed on a strip portion of the thin-film MgO layer that extends in the row direction and includes portions each facing the joint portion of the T-shaped transparent electrode Xa (Ya) lying between the wide distal end Xa1 (Ya1) and the narrow proximal end Xa2 (Ya2).

The structure of the other components in FIG. 15 is the same as that in the first embodiment and designated by the same reference numerals as those in the first embodiment.

Further, the structure of the crystalline MgO layer 35 and the method of forming it are the same as those in the first embodiment.

The PDP in the fourth embodiment has, in addition to the conventional type of the thin-film MgO layer formed by vapor deposition or the like, the crystalline MgO layers 35 formed of the MgO crystals causing a CL emission having a peak within a wavelength range from 200 nm to 300 nm (particularly, of 230 nm to 250 nm, around 235 nm) upon excitation by an electron beam. The crystalline MgO layers 35 are formed in a pattern of a stripe shape and each extends along a strip including each of the joint portions between the wide distal end Xa1 (Ya1) and the narrow proximal end Xa2 (Ya2) of the transparent electrodes Xa (Ya). This design allows an improvement of the discharge characteristics such as those relating to the discharge delay. Thus, the PDP of the present invention is capable of showing satisfactory discharge characteristics.

Each of the crystalline MgO layers 35 is formed in a region next to a region where a discharge intensely occurs, there by making it possible to greatly enhance the effect of shortening the discharge-delay time. Further, the crystalline MgO layers 35 are formed with avoiding the areas where a discharge most intensely occurs, thereby making it possible to control the light transmission reduction resulting from the re-buildup and the flying-off of the crystalline MgO because of the ion impact (spattering) when discharges are produced.

Because the crystalline MgO layer 35 is not formed on the entire face of the thin-film MgO layer, but only in a region where a discharge occurs, the PDP is capable of minimizing a light transmission reduction caused by the lamination of the thin-film MgO layer and the crystalline MgO layer 35.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Fifth Embodiment

Figure 16:
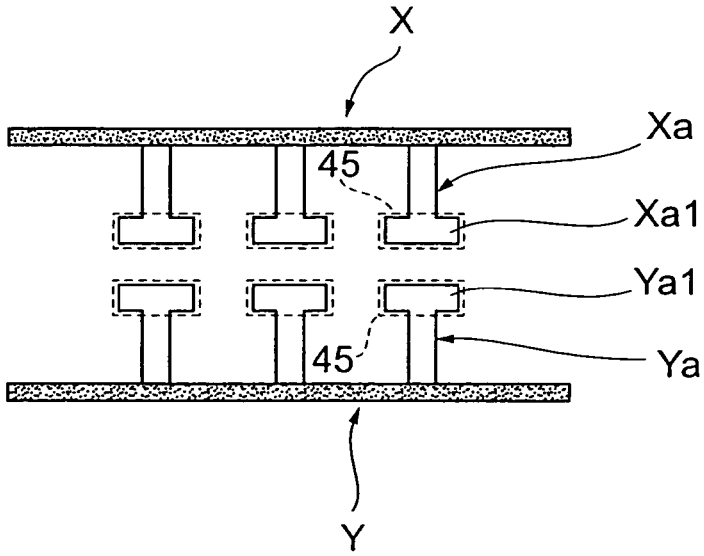
FIG. 16 is a front view illustrating a fifth embodiment according to the present invention.

FIG. 16 is a schematic block diagram illustrating a fifth embodiment according to the present invention.

The first embodiment has described the crystalline MgO layers each formed on a quadrangular portion of the thin-film MgO layer facing the discharge gap and the leading ends of the paired and opposing transparent electrodes on either side of the discharge gap.

On the other hand, the PDP in the fifth embodiment has crystalline MgO layers 45 formed in a pattern of an island form on the rear-facing face of a thin-film MgO layer which is formed as in the case of that in the first embodiment. Each of the crystalline MgO layers 45 is provided on a quadrangular portion of the thin-film MgO layer facing the entire face of the wide distal end Xa1 (Ya1) of each of the T-shaped transparent electrodes Xa (Ya) in each row electrode X (Y). The size of each crystalline MgO layer 45 is approximately the same as that of each of the wide distal ends Xa1 and Ya1.

The structure of the other components in FIG. 16 is the same as that in the first embodiment and designated by the same reference numerals as those in the first embodiment.

Further, the structure of the crystalline MgO layer 45 and the method of forming it are the same as those in the first embodiment.

The PDP in the fifth embodiment has, in addition to the conventional type of the thin-film MgO layer formed by vapor deposition or the like, the crystalline MgO layers 45 formed of the MgO crystals causing a CL emission having a peak within a wavelength range from 200 nm to 300 nm (particularly, of 230 nm to 250 nm, around 235 nm) upon excitation by an electron beam. The crystalline MgO layers 45 are formed in a pattern of an island form, and each located in the quadrangular area corresponding to the entire face of the wide distal end Xa1 (Ya1) of the transparent electrode Xa (Ya).

This design allows an improvement of the discharge characteristics such as those relating to the discharge delay. Thus, the PDP of the present invention is capable of showing satisfactory discharge characteristics.

Specially, each of the crystalline MgO layers 45 is formed in a region where a discharge intensely occurs, thereby making it possible to greatly enhance the effect of shortening the discharge-delay time.

Because the crystalline MgO layer 45 is not formed on the entire face of the thin-film MgO layer, but only in a region where a discharge occurs, the PDP is capable of minimizing a light transmission reduction caused by the lamination of the thin-film MgO layer and the crystalline MgO layer 45.

Further, the formation of the crystalline MgO layers 45 in a pattern as described above makes it possible to minimize the occurrence of a reduction in the discharge characteristics and a reduction in light transmission in an agglomeration area of the crystalline MgO resulting from the re-buildup of the crystalline MgO having flied off because of the ion impact (spattering) caused by discharges repeated in the discharge cell.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Sixth Embodiment

Figure 17:
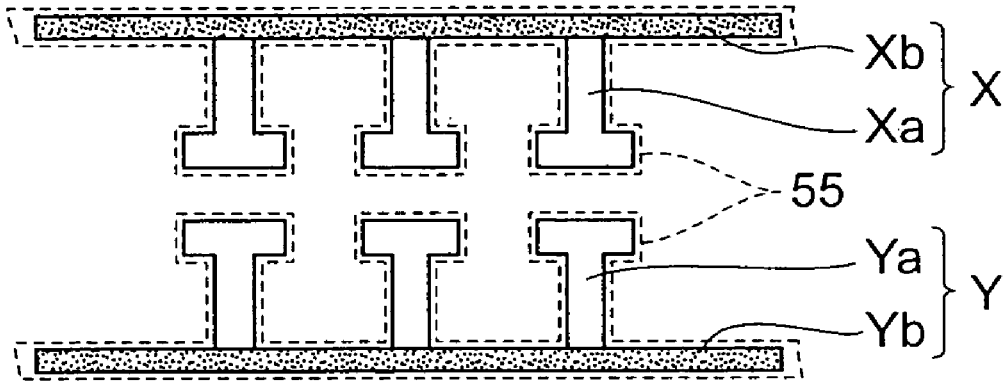
FIG. 17 is a front view illustrating a sixth embodiment according to the present invention.

FIG. 17 is a schematic block diagram illustrating a sixth embodiment according to the present invention.

The crystalline MgO layers 45 described in the fifth embodiment are formed in a pattern of an island form and each provided on a quadrangular portion of the thin-film MgO layer facing the entire face of each of the wide distal ends of the T-shaped transparent electrodes in each row electrode and has approximately the same area as that of the wide distal end.

On the other hand, crystalline MgO layers 55 of the PDP in the sixth embodiment are formed in a pattern of approximately the same shape as that of the row electrode X, Y on the rear-facing face of a thin-film MgO layer formed as in the case in the first embodiment. Each of the crystalline MgO layers 55 is formed on a portion of the thin-film MgO layer facing the entire face of the row electrode X (Y), that is, the entire faces of the transparent electrodes Xa (Ya) and the bus electrode Xb (Yb).

The structure of the other components in FIG. 17 is the same as that in the first embodiment and designated by the same reference numerals as those in the first embodiment.

Further, the structure of the crystalline MgO layer 55 and the method of forming it are the same as those in the first embodiment.

The PDP in the sixth embodiment has, in addition to the conventional type of the thin-film MgO layer formed by vapor deposition or the like, the crystalline MgO layers 55 formed of the MgO crystals causing a CL emission having a peak within a wavelength range from 200 nm to 300 nm (particularly, of 230 nm to 250 nm, around 235 nm) upon excitation by an electron beam. The crystalline MgO layers 55 are formed in a pattern in areas corresponding to the transparent electrodes Xa, Ya and the bus electrodes Xb, Yb of the row electrodes X, Y. This design allows an improvement of the discharge characteristics such as those relating to the discharge delay. Thus, the PDP of the present invention is capable of showing satisfactory discharge characteristics.

Specially, each of the crystalline MgO layers 55 is formed in a region where a discharge intensely occurs, thereby making it possible to greatly enhance the effect of shortening the discharge-delay time.

Because the crystalline MgO layer 55 is not formed on the entire face of the thin-film MgO layer, but only in a region where a discharge occurs, the PDP is capable of minimizing a light transmission reduction caused by the lamination of the thin-film MgO layer and the crystalline MgO layer 55.

Further, the formation of the crystalline MgO layers 55 in a pattern as described above makes it possible to minimize the occurrence of a reduction in the discharge characteristics and a reduction in light transmission in an agglomeration area of the crystalline MgO resulting from the re-buildup of the crystalline MgO having flied off because of the ion impact (spattering) caused by discharges repeated in the discharge cell.

If a PDP has a partition wall unit for partitioning the discharge space (i.e. the partition wall unit 8 in FIGS. 1 and 2) and the bus electrodes Xb, Yb of the row electrodes X, Y are located opposite the transverse walls and therefore the portions of the dielectric layer covering the bus electrodes Xb, Yb are not bare in the discharge space as in the case of the PDP in the sixth embodiment, the crystalline MgO layers may be formed in only the areas corresponding to the transparent electrodes Xa, Ya, exclusive of the areas corresponding to the bus electrodes Xb, Yb.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Seventh Embodiment

Figure 18:
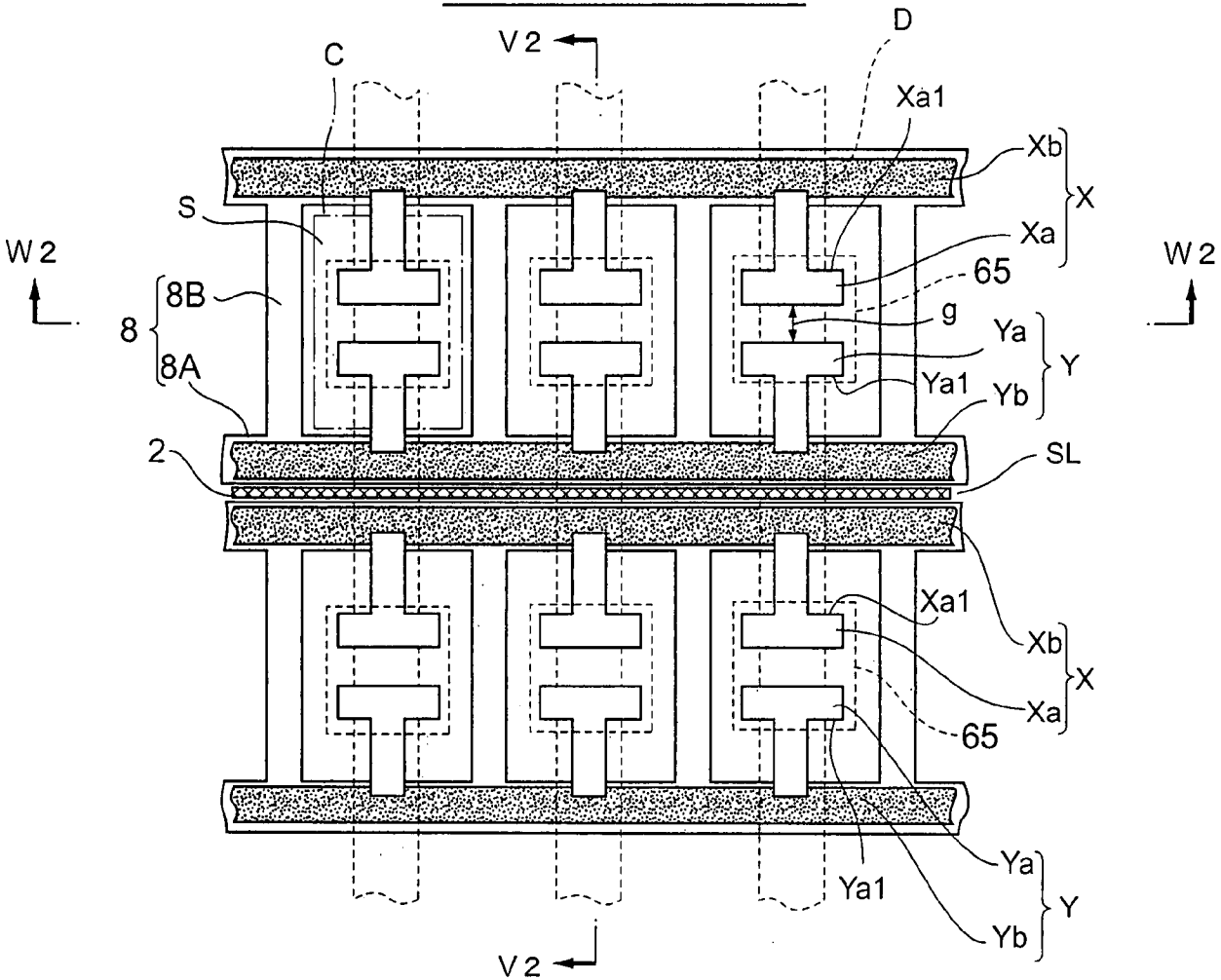
FIG. 18 is a front view illustrating a seventh embodiment according to the present invention.
Figure 19:
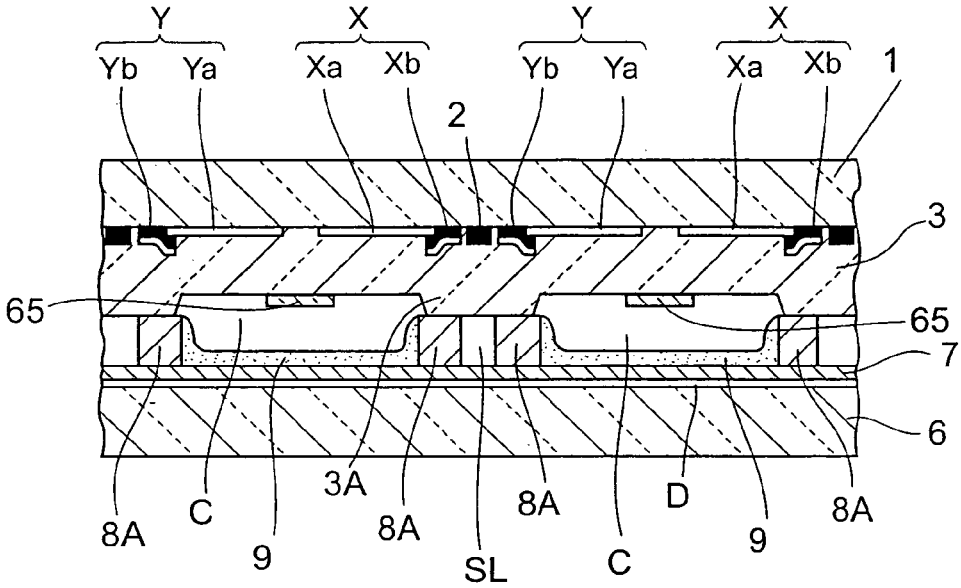
FIG. 19 is a sectional view taken along the V2-V2 line in FIG. 18.
Figure 20:
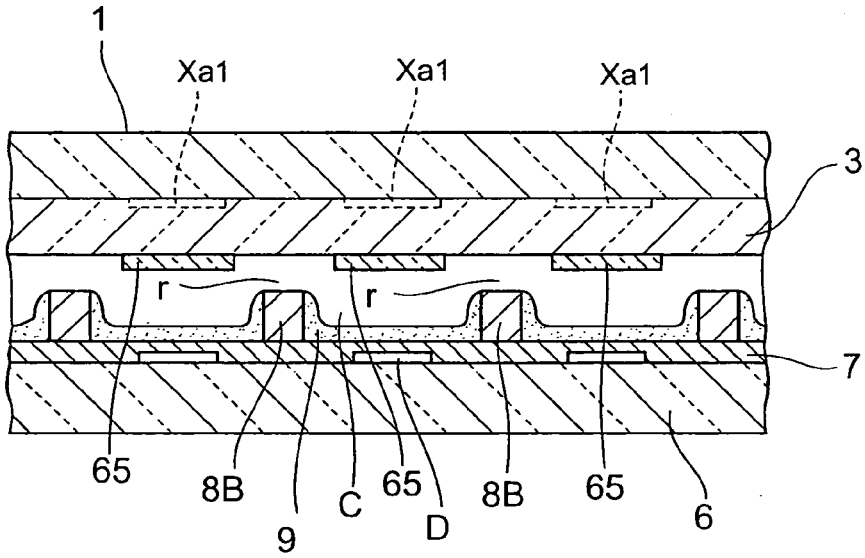
FIG. 20 is a sectional view taken along the W2-W2 line in FIG. 18.

FIGS. 18 to 20 illustrate a seventh embodiment of a PDP according to the present invention. FIG. 18 is a schematic front view of the PDP in the seventh embodiment. FIG. 19 is a sectional view taken along the V2-V2 line in FIG. 18. FIG. 20 is a sectional view taken along the W2-W2 line in FIG. 18.

In the following description, the same components of the PDP in the seventh embodiment as those of the PDP in the first embodiments are designated by the same reference numerals in FIGS. 18 to 20 as those used in FIGS. 1 to 3.

The crystalline MgO layer of the PDP in the first embodiment is laminated on the thin-film MgO layer. In the PDP of the seventh embodiment, a crystalline MgO layer is formed alone on the dielectric layer covering the row electrode pairs.

In FIGS. 18 to 20, as in the case of the first embodiment, a plurality of row electrode pairs (X, Y) extending in the row direction (the right-left direction in FIG. 18) of the front glass substrate 1 and arranged in parallel on the rear-facing face of a front glass substrate 1. The row electrode pairs (X, Y) are covered by a dielectric layer 3 formed on the rear-facing face of the front glass substrate 1.

Additional dielectric layers 3A are formed on the rear-facing face of the dielectric layer 3.

On the rear-facing faces of the first glass substrate 1 on which the dielectric layer 3 and the additional dielectric layers 3A are formed, magnesium oxide layers 65 including magnesium oxide single crystals (hereinafter referred to as "crystalline MgO layers 65"), which cause a cathode-luminescence emission (CL emission) having a peak within a wavelength range of 200 nm to 300 nm (particularly, of 230 nm to 250 nm, around 235 nm) upon excitation by electron beams, as in the case of that in the first embodiment, are each formed in an island form in a quadrangular area corresponding to the opposing parts of the transparent electrodes Xa and Ya (the approximately entire areas of the wide distal ends Xa1 and Ya1 bordering the discharge gap g between the transparent electrodes Xa and Ya) and this discharge gap g between the transparent electrodes Xa and Ya.

The structure on the back glass substrate 6 is the same as that in the first embodiment. The discharge space S between the front and back glass substrates 1 and 6 is filled with a discharge gas including xenon.

Figure 21:
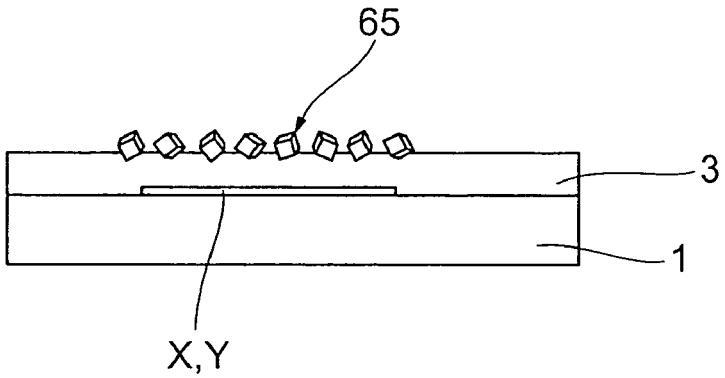
FIG. 21 is a sectional view showing the state of a crystalline magnesium oxide layer formed on a dielectric layer in the seventh embodiment.

FIG. 21 shows the state when the MgO crystals are affixed to the rear-facing face of the dielectric layer 3 by use of a spraying technique, electrostatic coating technique or the like to form the crystalline MgO layer 65.

The materials and method for forming the crystalline Mgo layer 65 are the same as in the case of the crystalline MgO layer in the first embodiment. The vapor-phase MgO single crystals used for forming the crystalline MgO layer 65 have an average particle diameter of 500 or more angstroms, preferably in a range from 2000 to 4000 angstroms, based on a measurement using the BET method. The crystalline MgO layer 65 can be formed by any method using various techniques such as a spraying technique, electrostatic coating technique, screen-printing technique, offset printing technique, dispenser technique, inkjet technique, roll-coating technique or the like.

The PDP produces a reset discharge, address discharge and sustaining discharge in the discharge cells C in order to generate images. The reset discharge initiated prior to the initiation of the address discharge triggers the radiation of vacuum ultraviolet light from the xenon included in the discharge gas. The vacuum ultraviolet light triggers the emission of secondary electrons (priming particles) from the crystalline MgO layer 65 formed so as to face the discharge cell C, resulting in a reduction in the breakdown voltage at the time of the subsequent address discharge and in turn a speeding up of the address discharge process.

Because the crystalline MgO layer 65 is formed, for example, of the vapor-phase MgO single crystal, the application of electron beam resulting from the discharge excites a CL emission having a peak within a wavelength range of 200 nm to 300 nm (particularly, of 230 nm to 250 nm, around 235 nm), in addition to a CL emission having a peak within a wavelength range of 300 nm to 400 nm, from the large-particle-diameter vapor-phase MgO single crystal included in the crystalline MgO layer 65. The presence of the CL emission having a peak wavelength from 200 nm to 300 nm can bring about a further improvement of the discharge characteristics of the PDP (a reduction in discharge delay, an increase in the probability of a discharge).

Figure 22:
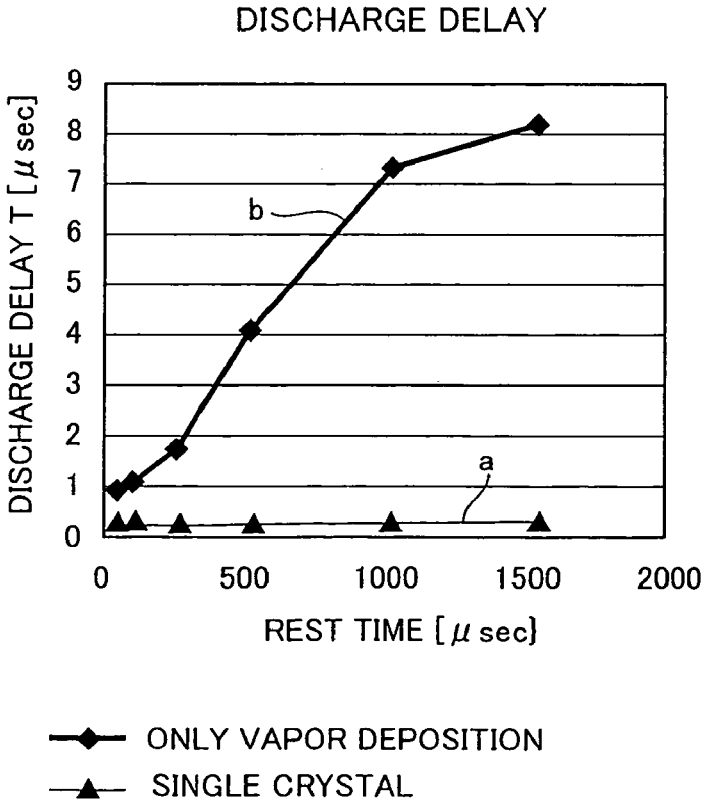
FIG. 22 is a graph showing the comparison of the discharge delay characteristics between the case when the protective layer is constituted only of the magnesium oxide layer formed by vapor deposition and that when the protective layer is constituted of only a crystalline magnesium oxide layer including a magnesium oxide single crystal.

FIG. 22 is a graph showing the discharge delay characteristics of the PDP having the crystalline MgO layer 65 including the vapor-phase MgO single crystals. It is seen from this graph that the discharge delay characteristics are significantly improved as compared with a conventional PDP having a thin-film MgO layer formed by vapor deposition, as in the case of the first embodiment.

The PDP of the first embodiment may possibly reduce in luminous efficiency because the formation of the thin-film MgO layer on the entire rear-facing face of the dielectric layer 3 may possibly lead to initiation of a useless discharge, for example, between the proximal ends (the parts connected to the bus electrodes Xb, Yb) of the transparent electrodes Xa, Ya and the bus electrodes Xb, Yb in which the electric field strength is low. However, in the PDP in the seventh embodiment, each of the crystalline MgO layers 65 alone is formed in an quadrangular area corresponding to the approximately entire areas of the wide distal ends Xa1 and Ya1 bordering the discharge gap g between the transparent electrodes Xa and Ya and this discharge gap g between the transparent electrodes Xa and Ya. For this reason, the discharge area for causing a sustaining discharge between the transparent electrodes Xa and Ya is restricted, so that a discharge is initiated only between the leading ends of the transparent electrodes Xa, Ya in which the electric field strength is high. In consequence, the PDP in the seventh embodiment is capable of providing a high luminous efficiency.

Further, the crystalline MgO layer 65 is formed of MgO single crystals, thus making it possible to significantly increase the lifespan of the PDP.

As described hitherto, the PDP of the present invention has the crystalline MgO layers 65 formed of the MgO crystals causing a CL emission having a peak within a wavelength range from 200 nm to 300 nm upon excitation by an electron beam and each formed on a quadrangular portion of the dielectric layer 3 facing the opposing portions of the transparent electrodes Xa and Ya and the discharge gap g between the transparent electrodes Xa and Ya. This design allows an improvement of the discharge characteristics such as those relating to the discharge delay. Thus, the PDP of the present invention is capable of showing satisfactory discharge characteristics.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Eighth Embodiment

Figure 23:
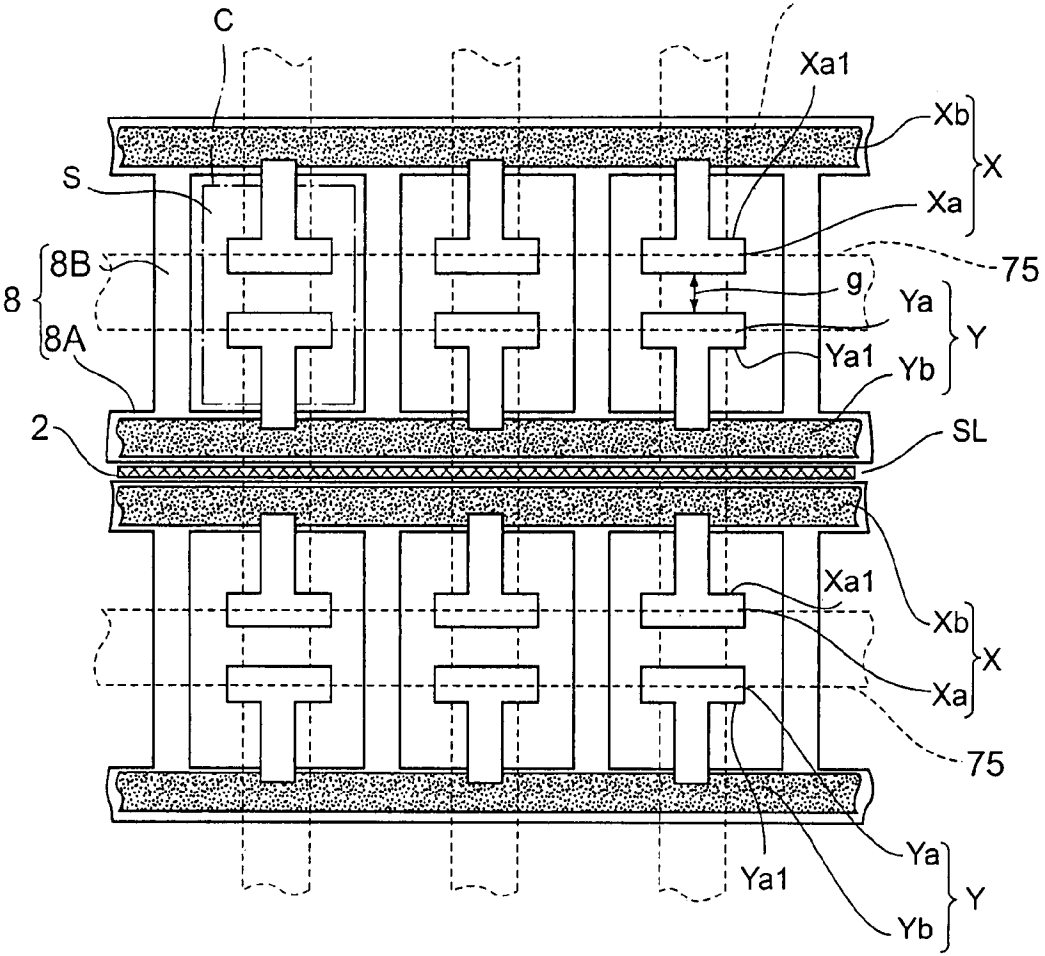
FIG. 23 is a front view illustrating an eighth embodiment according to the present invention.

FIG. 23 is a schematic front view illustrating a PDP in an eighth embodiment according to the present invention.

Each of the crystalline MgO layers of the PDP described in the seventh embodiment is formed in a so-called island form on the quadrangular portion of the dielectric layer facing the opposing portions of the transparent electrodes and the discharge gap between the opposing transparent electrodes.

On the other hand, crystalline MgO layers 75 of the PDP in the eighth embodiment are each formed in a bar shape continuously extending through the discharge cells C in the row direction, on the rear-facing face of the dielectric layer covering the row electrode pairs (X, Y). Each of the crystalline MgO layers 75 is formed on a portion of the dielectric layer facing the opposing portions of the transparent electrodes Xa and Ya (the wide distal ends Xa1, Ya1 bordering the discharge gap g between the transparent electrodes Xa and Ya) and also facing the discharge gap g between the transparent electrodes Xa and Ya.

The structure of the other components of the PDP in the eighth embodiment is approximately the same as that in the seventh embodiment and the components in FIG. 23 are designated by the same reference numerals in FIG. 18.

The materials and method for forming the crystalline MgO layer 75 are approximately the same as those in the seventh embodiment.

In much the same fashion as the PDP in the seventh embodiment, in the PDP in the eighth embodiment the discharge area for causing a sustaining discharge between the transparent electrodes Xa and Ya is restricted by the crystalline MgO layer 75, so that a discharge is initiated only between the leading ends of the transparent electrodes Xa, Ya in which the electric field strength is high. In consequence, the PDP in the eighth embodiment is capable of providing a high luminous efficiency. Further, the crystalline MgO layer 75 is formed of MgO single crystals, thus making it possible to significantly increase the lifespan of the PDP.

The PDP described above has the crystalline MgO layers 75 formed of the MgO crystals causing a CL emission having a peak within a wavelength range from 200 nm to 300 nm upon excitation by an electron beam. This design allows an improvement of the discharge characteristics such as those relating to the discharge delay. Thus, the PDP of the present invention is capable of showing satisfactory discharge characteristics.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

Ninth Embodiment

Figure 24:
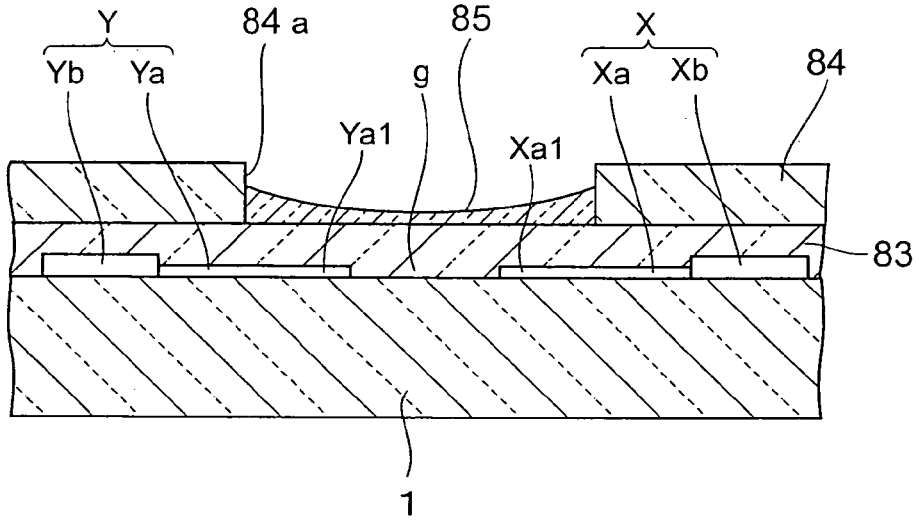
FIG. 24 is a side sectional view illustrating a ninth embodiment according to the present invention.
Figure 25:
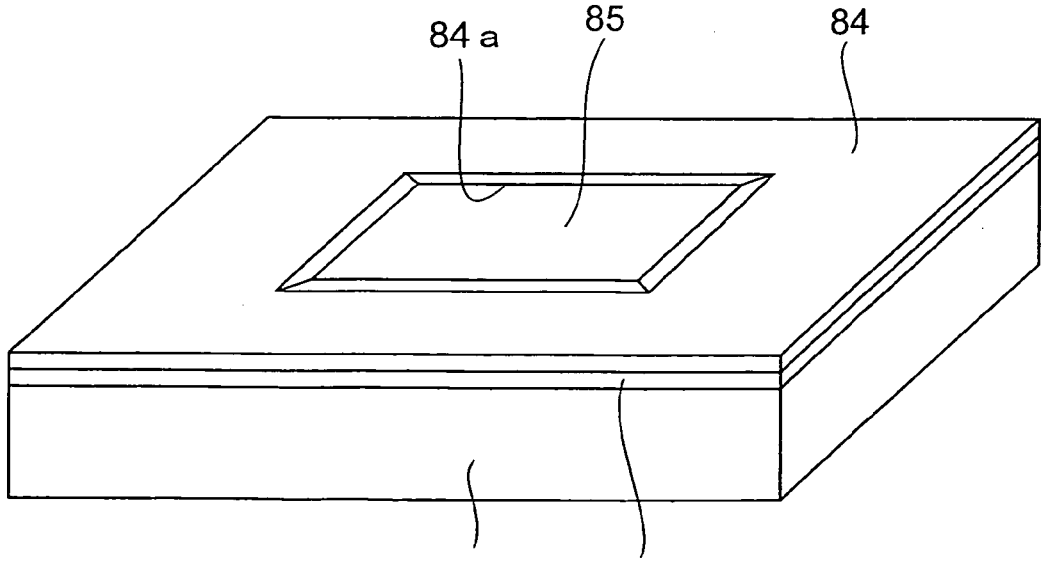
FIG. 25 is a perspective view of the ninth embodiment.

FIGS. 24 and 25 are schematic views illustrating a PDP in a ninth embodiment according to the present invention.

Each of the crystalline MgO layers of the PDP described in the seventh embodiment extends out from the dielectric layer toward the discharge space.

On the other hand, crystalline MgO layers of the PDP in the ninth embodiment are formed in openings formed in a second dielectric layer which is laminated on the rear-facing face of the first dielectric layer covering the row electrode pairs.

More specifically, in FIGS. 24 and 25, the second dielectric layer 84 having a required film-thickness is laminated on the rear-facing face of the first dielectric layer 83 which has a required film-thickness and is formed on the rear-facing face of the front glass substrate 1 so as to cover the row electrode pairs (X, Y).

The second dielectric layer 84 has quadrangular-shaped openings 84*a* each formed in a portion of the second dielectric layer 84 facing the opposing portions of the transparent electrodes Xa and Ya of the row electrodes X and Y located on either side of the discharge gap g (the wide distal ends Xa1, Ya1 bordering the discharge gap g between the transparent electrodes Xa and Ya) and also facing the discharge gap g between the transparent electrodes Xa and Ya.

Each of the crystalline MgO layers 85 is formed on the first dielectric layer 83 within the opening 84*a* of the second dielectric layer 84, and covers the surface of the first dielectric layer 83 within the opening 84*a*.

The structure of the other components of the PDP in the ninth embodiment is approximately the same as that in the seventh embodiment and the same components as those in the seventh embodiment are designated by the same reference numerals in FIG. 18.

The materials and method for forming the crystalline MgO layer 85 are approximately the same as those in the seventh embodiment.

In much the same fashion as the PDP in the seventh embodiment, in the PDP in the ninth embodiment the discharge area for causing a sustaining discharge between the transparent electrodes Xa and Ya is restricted by the crystalline MgO layer 85, so that a discharge is initiated only between the leading ends of the transparent electrodes Xa, Ya in which the electric field strength is high. In consequence, the PDP in the ninth embodiment is capable of providing a high luminous efficiency. Further, in addition to the technical effects of the PDP in the seventh embodiment, it is possible to further reduce the spreading of the discharge area of the sustaining discharge because the crystalline MgO layers 85 are formed in the openings 84*a* of the second dielectric layer 84.

The PDP described above has the crystalline MgO layers 85 formed of the MgO single crystals causing a CL emission having a peak within a wavelength range from 200 nm to 300 nm upon excitation by an electron beam. This design makes it possible to increase the lifetime of the PDP, and to improve the discharge characteristics such as those relating to the discharge delay, whereby the PDP is capable of showing satisfactory discharge characteristics.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

The PDP in each of the embodiments is described under the comprehensive idea that a PDP has a pair of substrates placed opposite each other on either side of a discharge space, discharge electrodes formed on one of the opposing substrates, and a dielectric layer covering the discharge electrodes, unit light emission areas being formed in the discharge space, and is provided with crystalline magnesium oxide layers which includes magnesium oxide crystals causing a cathode-luminescence emission having a peak within a wavelength range of 200 nm to 300 nm upon excitation by an electron beam and which are each provided on a portion of the substrate having the discharge electrodes formed thereon and facing the discharge space.

In the PDP based on the comprehensive idea, each of he crystalline magnesium oxide layers including magnesium oxide crystals causing a cathode-luminescence emission having a peak within a wavelength range of 200 nm to 300 nm upon excitation by an electron beam is formed on at least a part facing the discharge electrode within the portion of the dielectric layer facing the unit light emission area. Because of this, the discharge characteristics of the PDP such as those relating to the discharge delay are improved. Thus, the PDP in the exemplary embodiment is capable of having satisfactory discharge characteristics.

Further, the formation of each of the crystalline magnesium oxide layers in a selected area including an area facing the discharge electrode makes it possible to greatly enhance the effect of shortening the discharge-delay time and to minimize the light-transmission reduction caused by the formation of the crystalline magnesium oxide layers.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, having a pair of substrates placed opposite each other on either side of a discharge space, discharge electrodes formed on one of the opposing substrates, and a dielectric layer covering the discharge electrodes, unit light emission areas being formed in the discharge space, comprising:

crystalline magnesium oxide layers including magnesium oxide crystals causing a cathode-luminescence emission having a peak within a wavelength range of 200 nm to 300 nm upon excitation by an electron beam, and each provided on a portion of the substrate having the discharge electrodes formed thereon and facing the discharge space.

2. A plasma display panel according to claim 1, further comprising a thin-film magnesium oxide film formed by either vapor deposition or spattering and covering the dielectric layer, wherein each of the crystalline magnesium oxide layers is formed on a portion of the thin-film magnesium oxide layer facing the discharge space.

3. A plasma display panel according to claim 1, wherein the crystalline magnesium oxide layer is formed on a part of the dielectric layer within a portion of the dielectric layer facing the discharge space.

4. A plasma display panel according to claim 1, wherein the crystalline magnesium oxide layers are formed in a pattern to be located in areas facing the discharge electrodes.

5. A plasma display panel according to claim 1, wherein the discharge electrodes comprise row electrode pairs each comprising a pair of row electrodes facing each other on either side of a discharge gap, wherein each row electrode in the row electrode pair includes an electrode body extending in a row direction and protruding electrode portions each extending out from the electrode body toward its counterpart row electrode in the row electrode pair to face a corresponding protruding electrode portion of the counterpart row electrode with the discharge gap in between.

6. A plasma display panel according to claim 5, wherein each of the crystalline magnesium oxide layers is formed in an area facing the protruding electrode portion of the row electrode.

7. A plasma display panel according to claim 6, wherein each of the crystalline magnesium oxide layers is formed in an area facing the discharge gap between the row electrode pair and distal end portions of the protruding electrode portions located opposite each other on either side of the discharge gap.

8. A plasma display panel according to claim 7, wherein each of the protruding electrode portions includes a wide distal end facing its counterpart protruding electrode portion of the other row electrode in the row electrode pair with the discharge gap in between, and a narrow proximal end making a connection between the wide distal end and the electrode body, each of the crystalline magnesium oxide layers faces a part of the wide distal end of the protruding electrode portion.

9. A plasma display panel according to claim 7, wherein the crystalline magnesium oxide layers are provided individually for each unit light emission area.

10. A plasma display panel according to claim 7, wherein each of the crystalline magnesium oxide layers is formed in a shape continuously extending through the adjacent unit light emission areas.

11. A plasma display panel according to claim 6, wherein the crystalline magnesium oxide layers are formed in areas facing intermediate portions of the protruding electrode portions facing each other with the discharge gap in between, except for distal end portions of the protruding electrode portions.

12. A plasma display panel according to claim 11, wherein each of the protruding electrode portions includes a wide distal end facing its counterpart protruding electrode portion of the other row electrode in the row electrode pair with the discharge gap in between, and a narrow proximal end making a connection between the wide distal end and the electrode body, each of the crystalline magnesium oxide layers faces a joint portion between the wide distal end and the narrow proximal end of the protruding electrode portion.

13. A plasma display panel according to claim 11, wherein the crystalline magnesium oxide layers are provided individually for each unit light emission area.

14. A plasma display panel according to claim 11, wherein each of the crystalline magnesium oxide layers is formed in a shape continuously extending through the adjacent unit light emission areas.

15. A plasma display panel according to claim 6, wherein each of the protruding electrode portions includes a wide distal end facing its counterpart protruding electrode portion of the other row electrode in the row electrode pair with the discharge gap in between, and a narrow proximal end making a connection between the wide distal end and the electrode body, each of the crystalline magnesium oxide layers is formed in an area facing the wide distal end of the protruding electrode portion.

16. A plasma display panel according to claim 5, wherein each of the crystalline magnesium oxide layers is formed in an area facing the electrode body and the protruding electrode portions.

17. A plasma display panel according to claim 1, wherein the crystalline magnesium oxide layers include magnesium oxide crystals having a particle diameter of 500 or more angstroms.

18. A plasma display panel according to claim 1, wherein the crystalline magnesium oxide layers include magnesium oxide crystals having a particle diameter of 2000 or more angstroms.

19. A plasma display panel according to claim 1, wherein the magnesium oxide crystals are produced by performing vapor-phase oxidation on magnesium steam generated by heating magnesium.

20. A plasma display panel according to claim 19, wherein the magnesium oxide crystals comprise magnesium oxide single crystals having a cubic single crystal structure.

21. A plasma display panel according to claim 19, wherein the magnesium oxide crystals comprise magnesium oxide single crystals having a cubic polycrystal structure.

22. A plasma display panel according to claim 1, wherein the crystalline magnesium oxide layer causes a cathode-luminescence emission having a peak within a wavelength range from 230 nm to 250 nm upon excitation by an electron beam.

23. A plasma display panel according to claim 5, further comprising recessed portions recessed in a face of the dielectric layer facing toward the discharge space, and each formed in a portion of the dielectric layer facing a region including the discharge gap between the row electrode pair and distal end portions of the protruding electrode portions facing each other on either side of the discharge gap, wherein each of the crystalline magnesium oxide.

* * * * *